US011235384B2

(12) United States Patent
Fukunaga et al.

(10) Patent No.: US 11,235,384 B2
(45) Date of Patent: Feb. 1, 2022

(54) SLIDING NOZZLE

(71) Applicants: KROSAKIHARIMA CORPORATION, Fukuoka (JP); NIPPON STEEL CORPORATION, Tokyo (JP)

(72) Inventors: Shinichi Fukunaga, Fukuoka (JP); Kouji Kawarada, Fukuoka (JP); Kohei Tani, Fukuoka (JP); Masashi Oikawa, Tokyo (JP)

(73) Assignees: KROSAKIHARIMA CORPORATION, Fukuoka (JP); NIPPON STEEL CORPORATION, Tokyo (JP)

( * ) Notice: Subject to any disclaimer, the term of this patent is extended or adjusted under 35 U.S.C. 154(b) by 199 days.

(21) Appl. No.: 16/475,174

(22) PCT Filed: Dec. 8, 2017

(86) PCT No.: PCT/JP2017/044135
§ 371 (c)(1),
(2) Date: Jul. 1, 2019

(87) PCT Pub. No.: WO2018/128049
PCT Pub. Date: Jul. 12, 2018

(65) Prior Publication Data

US 2019/0337050 A1 Nov. 7, 2019

(30) Foreign Application Priority Data

Jan. 5, 2017 (JP) ..... JP2017-000689

(51) Int. Cl.
*B22D 41/24* (2006.01)
*B22D 11/10* (2006.01)
*B22D 41/42* (2006.01)

(52) U.S. Cl.
CPC ..... *B22D 41/24* (2013.01); *B22D 11/10* (2013.01); *B22D 41/42* (2013.01)

(58) Field of Classification Search
CPC ..... B22D 11/10; B22D 41/24; B22D 41/28; B22D 41/34; B22D 41/38; B22D 41/42
(Continued)

(56) References Cited

U.S. PATENT DOCUMENTS 4,545,512 A * 10/1985 Shapland ..... B22D 41/24 222/561
4,641,768 A * 2/1987 Hill ..... B22D 41/42 222/590
(Continued)

FOREIGN PATENT DOCUMENTS

AU 5518501 A 9/2001
CA 2402528 A1 9/2001
(Continued)

OTHER PUBLICATIONS

English translation of International Preliminary Report dated Jul. 9, 2019 with Written Opinion for PCT/JP2017/044135 filed Dec. 8, 2017.

*Primary Examiner* — Scott R Kastler
*Assistant Examiner* — Michael Aboagye
(74) *Attorney, Agent, or Firm* — Paul D. Bianco; Katharine Davis; Fleit Intellectual Property Law

(57) ABSTRACT

In a sliding nozzle comprising three plates consisting of an upper plate, an intermediate plate capable of a sliding movement, and a lower plate, it is intended to suppress adhesion and deposition of metal oxides and others on wall surfaces of inner bores of the three plates. The intermediate plate has: a first inclined portion whose surface defines a slidingly closing directional leading-side wall surface of an inner bore thereof and extends obliquely downwardly in a diametrically contracting direction; a second inclined por-
(Continued)

tion whose surface defines an upper part of a slidingly closing directional trailing-side wall surface of the inner bore thereof and extends obliquely downwardly in a diametrically contracting direction, and a third inclined portion whose surface defines a lower part of the slidingly closing directional trailing-side wall surface of the inner bore thereof and extends obliquely downwardly in a diametrically expanding direction.

5 Claims, 9 Drawing Sheets

(58) Field of Classification Search
USPC ..... 222/590, 597, 600; 164/435, 437

See application file for complete search history.

(56) References Cited

U.S. PATENT DOCUMENTS

| | | | | |
|---|---|---|---|---|
| 5,518,154 | A * | 5/1996 | Vassilicos | B22D 41/24 222/600 |
| 6,783,038 | B2 * | 8/2004 | Xu | B22D 41/24 222/590 |
| 7,290,685 | B2 * | 11/2007 | Yotabun | B22D 41/28 222/594 |

FOREIGN PATENT DOCUMENTS

| | | | |
|---|---|---|---|
| JP | S54120527 | U | 2/1979 |
| JP | 2002160046 | A | 6/2002 |
| JP | 2002336957 | A | 11/2002 |
| JP | 2003526516 | A | 9/2003 |
| TW | 459122 | B | 10/2001 |
| WO | 01/68296 | A1 | 9/2001 |

* cited by examiner

SLIDING NOZZLE

TECHNICAL FIELD

The present invention relates to a sliding nozzle for controlling the flow rate of molten steel. As used in the present invention, the term "sliding nozzle" means a structure comprising an upper nozzle, an upper plate, an intermediate plate, and a lower plate, wherein the structure is comprised in a sliding nozzle device for adjusting start and stop timings of discharge of molten steel in a molten steel container and the flow rate of the molten steel through an opening-closing operation by a sliding movement of the intermediate plate.

BACKGROUND ART

In an operation of discharging molten steel from a ladle to a tundish or from the tundish to a casting mold, a sliding nozzle having a molten steel flow rate control function is installed at the bottom of the ladle or tundish to control the flow rate of the molten steel to be discharged therefrom.

Such molten steel to be discharged contains metal oxides, so that, particularly, during the operation of discharging molten steel from the tundish to the casting mold, the metal oxides adhere to and deposit (build up) on a wall surface of an inner bore of the sliding nozzle. In particular, aluminum-killed steel using aluminum as a deoxidizing agent, stainless steel particularly containing a rare metal such as La or Ce, or the like, includes a steel grade which is more likely to cause adhesion and deposition (build-up) of metal oxides.

Further, the sliding nozzle is configured to adjust the degree of opening (effective flow passage area) defined by inner bores of a plurality of plates to thereby control the flow rate of the molten steel. Thus, a flow pattern is largely changed in the inner bores, and thereby metal oxides and metals (hereinafter referred to "metal oxides and others") become more likely to adhere to and deposit on wall surfaces of the inner bores of the plates. The progress of adhesion and deposition of metal oxides and others causes clogging of the sliding nozzle, thereby precluding discharge of the molten steel. Further, a change in flow pattern and a change in molten steel discharge speed are likely to exert an adverse influence on quality of steel.

As measures against the above adhesion and deposition or clogging in structural surfaces of the plates, for example, in the following Patent Document 1, there is disclosed a sliding nozzle composed of three plates consisting of an upper plate, a sliding plate (which is an intermediate plate capable of a sliding movement), and a lower plate, wherein at least a part of a wall surface of an inner bore of the sliding plate facing in a slidingly closing direction of the sliding plate (i.e., a part of the wall surface of the inner bore of the sliding plate on a trailing-side in the slidingly opening direction (a slidingly closing directional trailing-side inner bore wall surface of the sliding plate)) has a taper shape which diametrically expands downwardly from a top edge to a bottom edge thereof.

Further, in the following Patent Document 2, there is a disclosed a sliding nozzle comprising an upper plate, a sliding plate (which is an intermediate plate capable of a sliding movement), and a lower plate, wherein the sliding plate has a first cutout portion whose surface defines a slidingly closing directional trailing-side wall surface of an inner bore thereof and has an angle extending obliquely downwardly in a diametrically expanding direction, and the lower plate has a second cutout portion whose surface defines a part of a wall surface of an inner bore thereof located opposed to the first cutoff portion and has an angle extending obliquely downwardly in a diametrically contracting direction.

CITATION LIST

Parent Document

Patent Document 1: JP 2002-336957A

Patent Document 1: Microfilm of Utility Model Application No. S53-15048 (JP-U S54-120527A)

SUMMARY OF INVENTION

Technical Problem

In the Patent Document 1, although adhesion of metal oxides and others on at least the slidingly closing directional trailing-side inner bore wall surface of the sliding plate is slightly reduced as compared to the remaining part of the inner bore wall surface, adhesion of metal oxides and others in a region (recessed space lying between the upper and lower plates) around an opposite part of the inner bore wall surface (a part of the inner bore wall surface on a leading-side in the slidingly closing direction (a slidingly closing directional leading-side inner bore wall surface)) of the sliding plate is not reduced, as depicted in the Patent Document 1. Moreover, in the sliding nozzle disclosed in the Patent Document 1, a large amount of metal oxides and others will deposit on a step-like region (wall surface of an inner bore of the upper plate) located above the sliding plate.

In the Patent Document 2, in addition to the first cutout portion which is similar to the part of the inner bore wall surface formed in the taper shape which diametrically expands downwardly from the top edge to the bottom edge thereof, in the sliding plate disclosed in the Patent Document 1, the second cutout portion whose surface extends obliquely downwardly in the diametrically contracting direction is formed as the part of the inner bore wall surface of the lower plate located opposed to the first cutoff portion. However, a large amount of metal oxides and others will deposit in on a step-like region located above the sliding plate, and a recessed space lying between the upper and lower plates in the inner bore of the sliding plate (particularly, an upper region of the recessed space). Moreover, in the sliding nozzle disclosed in the Patent Document 2, turbulence of a molten steel stream is significant in a region below the slidingly closing directional trailing-side inner bore wall surface of the sliding plate, and thereby it is impossible to eliminate the phenomenon that metal oxides and others adhere to and deposit on the inner bore wall surface of the upper or lower plate.

A problem to be solved by the present invention is to, in a sliding nozzle comprising three plates consisting of an upper plate, an intermediate plate capable of a sliding movement, and a lower plate, suppressing adhesion and deposition of metal oxides and others on wall surfaces of inner bores of the three plates, particularly, suppressing adhesion and deposition of metal oxides and others on wall surfaces of inner bores of the intermediate and lower plates.

Solution to Technical Problem

The present invention provides a sliding nozzle having the following features (1) to (5).

(1) A sliding nozzle for controlling a flow rate of molten steel, which comprises three plates consisting of an upper plate, an intermediate plate capable of a sliding movement, and a lower plate, wherein the intermediate plate has: a first inclined portion whose surface defines a slidingly closing directional leading-side wall surface of an inner bore thereof and extends obliquely downwardly in a diametrically contracting direction; a second inclined portion whose surface defines an upper part of a slidingly closing directional trailing-side wall surface of the inner bore thereof and extends obliquely downwardly in a diametrically contracting direction, and a third inclined portion whose surface defines a lower part of the slidingly closing directional trailing-side wall surface of the inner bore thereof and extends obliquely downwardly in a diametrically expanding direction.

(2) In the sliding nozzle set forth in (1), the lower plate has a fourth inclined portion whose surface defines a slidingly closing directional leading-side wall surface of an inner bore thereof and extends obliquely downwardly in a diametrically contracting direction.

(3) In the sliding nozzle set forth in (1) or (2), respective sliding directional inner bore dimensions of the intermediate plate and the upper plate in a region where the intermediate plate and the upper plate are in sliding contact with each other satisfy the following relation: the inner bore dimension of the intermediate plate≥the inner bore dimension of the upper plate, and respective sliding directional inner bore dimensions of the lower plate and the intermediate plate in a region where the lower plate and the intermediate plate are in sliding contact with each other satisfy the following relation: the inner bore dimension of lower plate≥the inner bore dimension of the intermediate plate.

(4) In the sliding nozzle set forth in any one of (1) to (3), a central axis of an inner bore of the upper plate (hereinafter referred to as "upper inner bore axis") lies non-coaxially with a central axis of an inner bore of the lower plate (hereinafter referred to as "lower inner bore axis"), wherein the lower inner bore axis is offset on the slidingly closing directional leading-side with respect to the upper inner bore axis.

(5) The sliding nozzle set forth in any one of (1) to (4), which further comprises a refractory member installed to at least one of the upper plate and an upper nozzle located above the upper plate and configured to inject gas into an inner bore of the at least one of the upper plate and the upper nozzle.

The term "slidingly closing directional trailing-side" here means a trailing-side in a slidingly closing direction along which the intermediate plate closes the sliding nozzle (in other words, a leading-side in a slidingly opening direction along which the intermediate plate opens the sliding nozzle). On the other hand, the term "slidingly closing directional leading-side" here means a leading-side in the slidingly closing direction along which the intermediate plate closes the sliding nozzle (in other words, a trailing-side in the slidingly opening direction along which the intermediate plate opens the sliding nozzle)

Effect of Invention

The present invention makes it possible to suppress adhesion and deposition of metal oxides and others on the inner bore wall surfaces of the three plates, particularly the intermediate and lower plates, of the sliding nozzle, or suppress clogging of the inner bores of the three plates, particularly the intermediate and lower plates, due to metal oxides and others. Further, the present invention makes it possible to suppress stagnation of molten steel within the inner bore of the intermediate plate.

DESCRIPTION OF EMBODIMENTS

Figure 1:
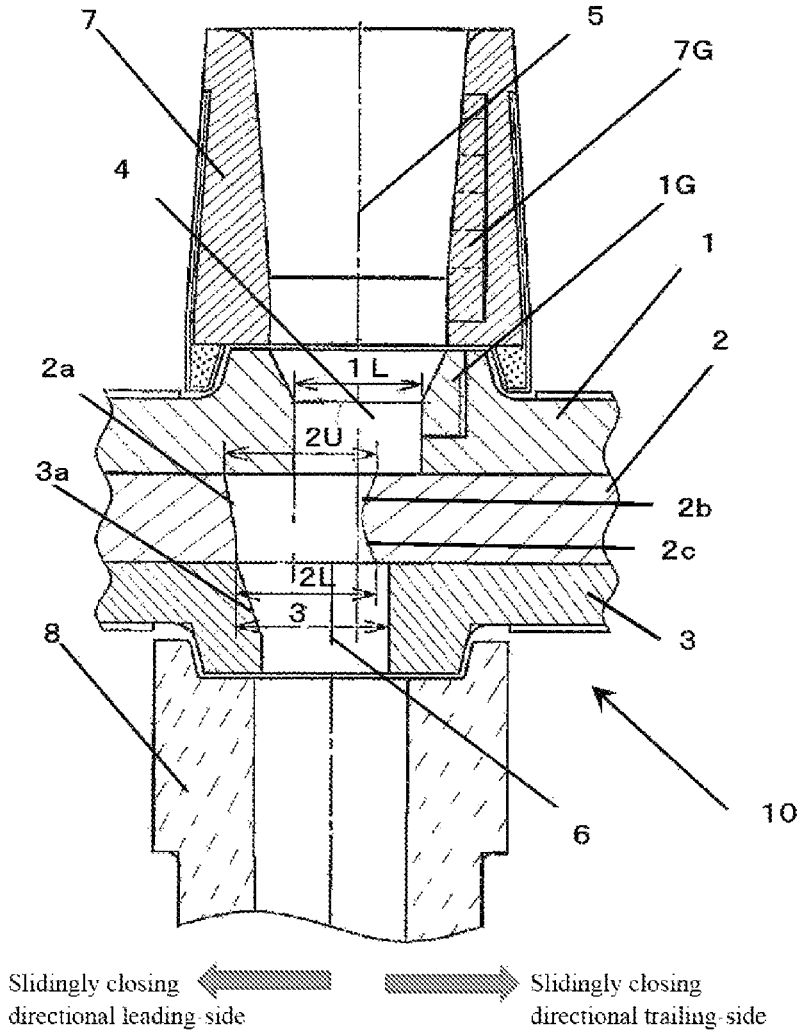
FIG. 1 is a schematic diagram of a sliding nozzle according to one embodiment of the present invention, wherein a left half of the diagram with respect to a vertical central axis depicts a structure in a case where a refractory member for injecting gas into an inner bore of the sliding nozzle is not installed, and a right half of the diagram with respect to the vertical central axis depicts a structure in a case where the refractory member for injecting gas into the inner bore is installed in both an upper nozzle and an upper plate of the sliding nozzle.
Figure 2:
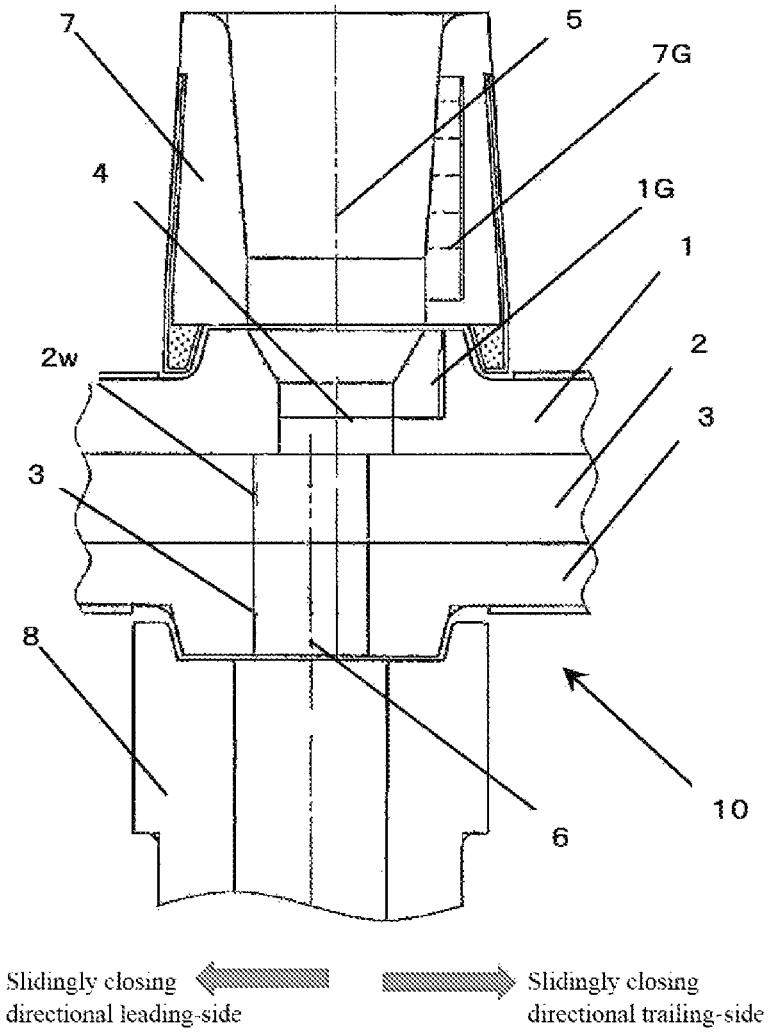
FIG. 2 is a schematic diagram of one example of a conventional sliding nozzle, wherein a left half of the diagram with respect to a vertical central axis depicts a structure in a case where a refractory member for injecting gas into an inner bore of the sliding nozzle is not installed, and a right half of the diagram with respect to the vertical central axis depicts a structure in a case where the refractory member for injecting gas into the inner bore is installed in both an upper nozzle and an upper plate of the conventional sliding nozzle.

With reference to FIG. 1, a sliding nozzle according to one embodiment of the present invention will now be described. The sliding nozzle 10 is designed to control a flow rate of molten steel, and comprises three plates consisting of an upper plate 1, an intermediate plate 2 capable of a sliding movement and a lower plate 3. The intermediate plate 2 has a first inclined portion 2*a* whose surface defines a slidingly closing directional leading-side wall surface of an inner bore thereof and extends obliquely downwardly in a diametrically contracting direction. The first inclined portion 2*a* may be formed to the extent enough to cause a change in flow pattern of molten steel, specifically in flow direction of the molten steel, as compared to a case where the intermediate plate is devoid of the first inclined portion 2*a*, to obtain an effect of reducing adhesion of metal oxides and others on inner bore wall surfaces of the plates. That is, a vertical length of the first inclined portion 2*a* may be a part or the entirety of the thickness of the intermediate plate, as long as it is enough to cause a change in flow pattern of molten steel. However, if an acute-angled portion is formed at a lower end of the inner bore of the intermediate plate 2, the acute-angled portion is likely to be significantly damaged. Thus, referring back to experience, it is preferable that the lower end is formed as a portion extending parallel to a central axis of the inner bore over at least about 5 mm.

Further, the angle of the first inclined portion 2*a* may be set to the extent enough to cause a change in flow pattern of molten steel. However, as the angle becomes larger, the length of an upper edge of the inner bore of the intermediate plate 2 in a sliding direction thereof becomes larger. If this length is excessively increased, it is likely to exert adverse influence on molten steel flow control, etc. Therefore, the angle of the first inclined portion 2*a* may be optimized in consideration of a relative relationship with the sliding directional length of the upper edge of the inner bore, on the basis of a sliding directional length of the inner bore set according on conditions for individual casting operation such as casting speed.

The intermediate plate 2 also has a second inclined portion (hereinafter referred to as "upper inclined portion") 2*b* whose surface defines an upper part of a slidingly closing directional trailing-side wall surface of the inner bore thereof and extends obliquely downwardly in a diametrically contracting direction. The vertical length and angle of the upper inclined portion 2*b* may be set to the extent enough to cause a change in flow pattern of molten steel, specifically in flow direction of the molten steel, as compared to a case where the intermediate plate is devoid of the upper inclined portion 2*a*, as with the first inclined portion 2*a*.

The intermediate plate 2 further has a third inclined portion (hereinafter referred to as "lower inclined portion") 2*c* whose surface defines a lower part of the slidingly closing directional trailing-side wall surface of the inner bore thereof and extends obliquely downwardly in a diametrically expanding direction. Preferably, the lower inclined portion 2*c* is formed such that a sliding directionally (horizontally)-extending step-like region to be defined between a lower sliding surface of the intermediate plate 2 and an upper end of a slidingly closing directional trailing-side wall surface of an inner bore of the lower plate 3 is reduced A portion (boundary portion) between the upper inclined portion 2*b* and the lower inclined portion) 2*c* may be an intersection of two straight lines. However, from a viewpoint of more uniforming the flow pattern of molten steel, the boundary portion is preferably formed such that it smoothly curves (has a smoothly curved surface).

The vertical lengths and angles of the upper inclined portion 2*b* and the lower inclined portion 2*c* may be determined to realize the above preferred configurations, while taking into account the balance therebetween. Specifically, the ratio of the vertical length of the upper inclined portion 2*b* to the vertical length of the lower inclined portion 2*c* may be set in the range of 1:1 to 4:1. Further, the angles of the upper and lower inclined portions 2*b*, 2*c* may be determined to the extent that a step with respect to a lower end of a slidingly closing directional trailing-side wall surface of an inner bore of the upper plate 1 and a step with respect to the upper end of the slidingly closing directional trailing-side wall surface of the inner bore of the lower plate 3 are suppressed as small as possible, and no adverse influence is exerted on the molten steel flow control based on the sliding movement.

The lower plate 3 has a fourth inclined portion 3*a* whose surface defines a slidingly closing directional leading-side wall surface of the inner bore thereof and extends obliquely downwardly in a diametrically contracting direction. The vertical length and angle of the fourth inclined portion 3*a* of the lower plate 3 may be set to the extent enough to cause a change in flow pattern of molten steel, as with the first inclined portion 2*a* of the intermediate plate 2. Preferably, the fourth inclined portion 3*a* is formed such that a sliding directionally (horizontally)-extending step-like region to be defined between the lower sliding surface of the intermediate plate 2 and an upper end of the slidingly closing directional leading-side wall surface of the inner bore of the lower plate 3 is suppressed as small as possible. However, if an acute-angled portion is formed at a lower end of the inner bore of the lower plate 3, the acute-angled portion is likely to be significantly damaged. Thus, referring back to experience, it is preferable that the lower end is formed as a portion extending parallel to a central axis of the inner bore over at least about 5 mm.

The inner bore of the upper plate 1 may have a vertically-extending cylindrical shape, or a downwardly-tapered conical shape, wherein the cylindrical shape or the conical shape may be a flat shape whose length in the sliding direction is greater than a length in a direction orthogonal to the sliding direction.

From a viewpoint of suppressing turbulence of a molten steel stream and adhesion and deposition of metal oxides and others, it is more preferable that the length of a step-like region to be formed above each of an upper sliding surface of the intermediate plate and an upper sliding surface of the lower plate is suppressed as small as possible. As the step-like region becomes larger, a stagnation region of molten steel is increased, so that the adhesion and deposition is more likely to be accelerated in the stagnation region. Specifically, respective sliding directional inner bore dimensions of the three plates are set such that the inner bore dimension of a first one of the plates which is located below a second one of the remaining plates is set to a larger value than that of the second plate. That is, it is preferable that respective sliding directional inner bore dimensions of the intermediate plate and the upper plate in a region where the intermediate plate and the upper plate are in sliding contact with each other satisfy the following relation: the inner bore dimension 2U of the intermediate plate≥the inner bore dimension 1L of the upper plate, and respective sliding directional inner bore dimensions of the lower plate and the intermediate plate in a region where the lower plate and the intermediate plate are in sliding contact with each other satisfy the following relation: the inner bore dimension 3U of lower plate≥the inner bore dimension 2L of the intermediate plate.

More preferably, a central axis 5 of the inner bore of the upper plate 1 (hereinafter referred to as "upper inner bore axis") lies non-coaxially with the central axis 6 of the inner bore of the lower plate (hereinafter referred to as "lower inner bore axis"), wherein the lower inner bore axis 6 is offset on the slidingly closing directional leading-side with respect to the upper inner bore axis 5 (the aftermentioned inventive samples in FIGS. 7 and 8). This makes it possible to allow a molten steel stream to more smoothly flow downwardly during casting operation at a constant speed (at a constant narrowed opening of the sliding nozzle) and thus further reduce adhesion and deposition of metal oxides and others.

Further, a refractory member 1G (7G) may be installed to at least one of the upper plate 1 and an upper nozzle 7 located above the upper plate, to inject gas into an inner bore of the at least one of them. The injection of gas into the inner bore of the at least one of the upper plate 1 and the upper nozzle 7 has an effect of surfacing metal oxides and others, and thus provides an effect of reducing adhesion and deposition of metal oxides and others.

EXAMPLES

Experimental examples will be shown and described below. In the following Example A and Example B, with regard to a flow pattern of molten steel, a predominant flow pattern is extracted from knowledge obtained based in simulation and depicted, and, with regard to a state of adhesion and deposition, a typical pattern obtained by observation of a sliding nozzle after being used in actual casting operation is depicted. Further, as a state of the plates depicted in the figures, an open state of the intermediate plate at an approximately constant pouring speed, i.e., at a setup casting speed, is assumed. Further, in the actual casting operation, a refractory member for injecting gas into inner bores was installed to each of the upper nozzle and the upper plate.

Example A

Example A is an experimental example in which a sliding nozzle configured such that a central axis of an inner bore of an upper plate lies coaxially with a central axis of an inner bore of a lower plate is used to check the flow pattern of molten steel in inner bores and the state of adhesion and deposition of metal oxides and others on inner bore wall surfaces.

In the actual casting operation, the type of steel was stainless steel containing rare metal such as La and Ce each contained in an amount of 0.1 mass % or less, and the casting speed was 1 t/min or less. These conditions are the same as those in Example B.

Figure 3A:
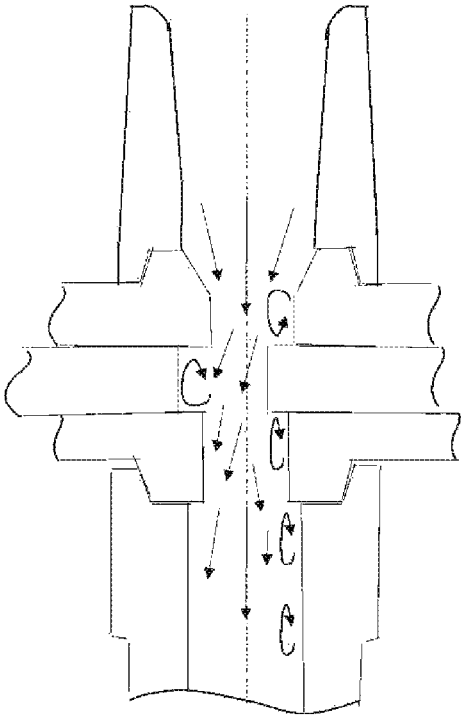
FIG. 3A is a schematic diagram depicting a flow pattern of molten steel in inner bores of a conventional sliding nozzle as a comparative sample 1 in which a central axis of inner bores of an upper plate and an upper nozzle lies coaxially with a central axis of an inner bore of a lower plate.
Figure 3B:
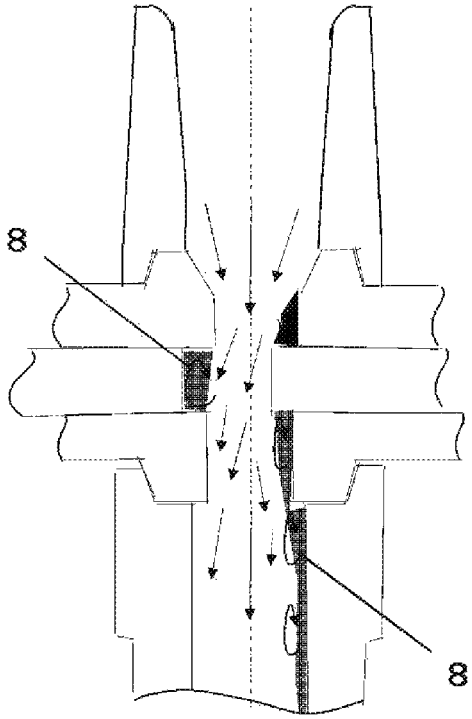
FIG. 3B is a schematic diagram depicting a state of adhesion of metal oxides and others on the inner bores in the conventional sliding nozzle as the comparative sample 1 in FIG. 3A.
Figure 4A:
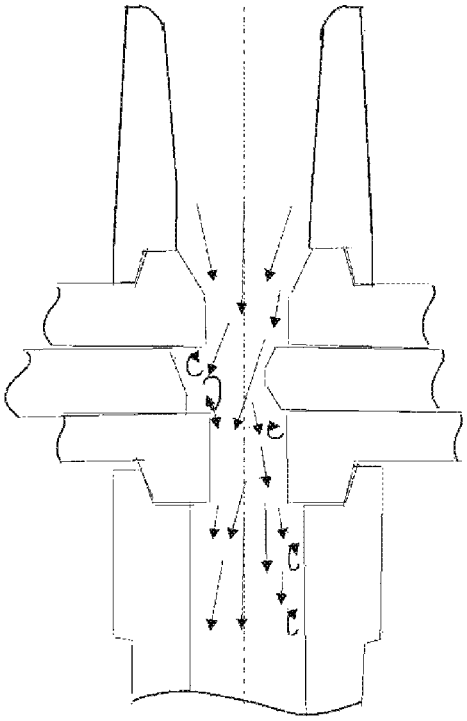
FIG. 4A is a schematic diagram depicting a flow pattern of molten steel in inner bores of a sliding nozzle as an inventive sample 1 in which a central axis of inner bores of an upper plate and an upper nozzle lies coaxially with a central axis of an inner bore of a lower plate, and an intermediate plate has an inclined portion defining a part of an inner bore wall surface thereof.
Figure 4B:
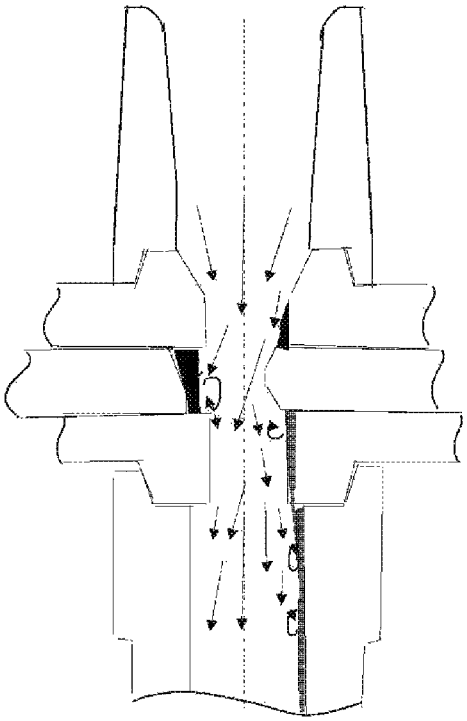
FIG. 4B is a schematic diagram depicting a state of adhesion of metal oxides and others on the inner bores in the sliding nozzle as the inventive sample 1 in FIG. 4A.
Figure 5A:
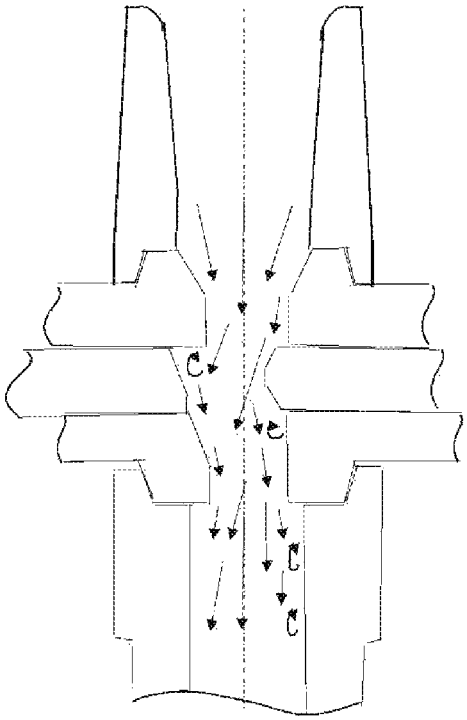
FIG. 5A is a schematic diagram depicting a flow pattern of molten steel in inner bores of a sliding nozzle as an inventive sample 2 in which a central axis of inner bores of an upper plate and an upper nozzle lies coaxially with a central axis of an inner bore of a lower plate, and each of an intermediate plate and the lower plate has an inclined portion defining a part of an inner bore wall surface thereof.
Figure 5B:
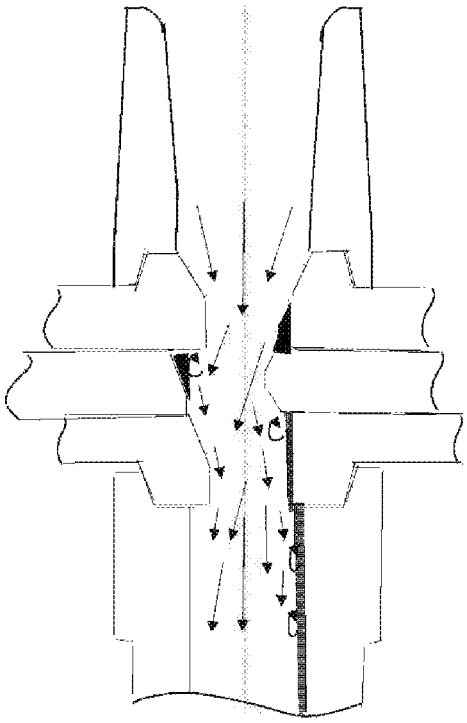
FIG. 5B is a schematic diagram depicting a state of adhesion of metal oxides and others on the inner bores in the sliding nozzle as the inventive sample 2 in FIG. 5A.
Figure 9:
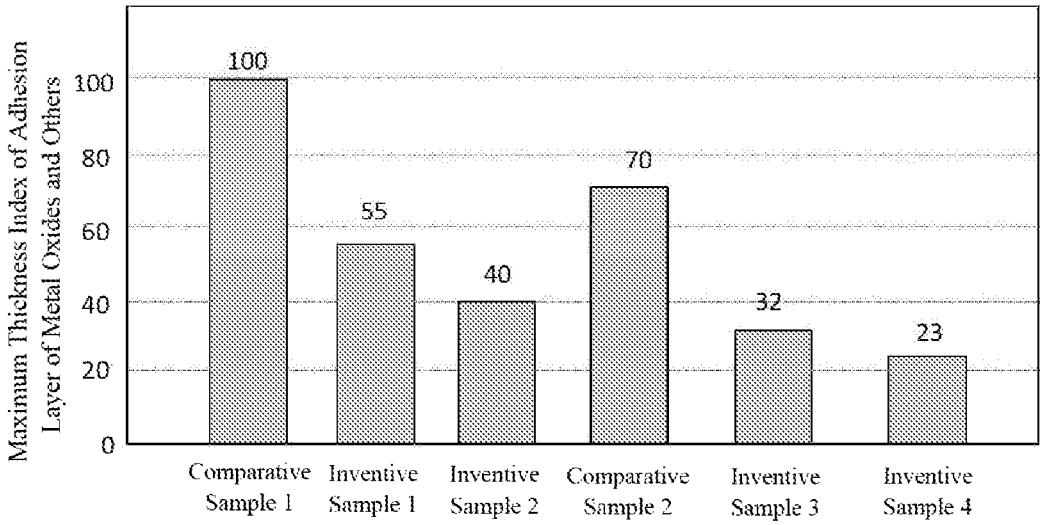
FIG. 9 is a graph presenting a state of adhesion of metal oxides and others on inner bores of the intermediate plate, the lower plate and the lower nozzle (immersion nozzle) depicted in each of FIGS. 3B to 8B, wherein the thickness of an adhesion layer of the metal oxides and others is indicated by a maximum thickness index.

FIG. 3A, FIG. 4A and FIG. 5A are schematic diagrams depicting respective structures of a comparative sample 1 and inventive samples 1 and 2, and FIG. 3B, FIG. 4B and FIG. 5B are schematic diagrams depicting respective states of adhesion and deposition of metal oxides and others on inner bore wall surfaces of these sliding nozzles. FIG. 9 is a graph presenting a relative relationship of the states of adhesion of metal oxides and others in FIGS. 3B, 4B and 5B, wherein the thickness of an adhesion layer of the metal oxides and others is indicated by an index determined on the assumption that the maximum thickness in FIGS. 3A and 3B (comparative sample 1) is 100.

FIGS. 3A and 3B a comparative sample (conventional sliding nozzle) having a columnar shape in which an inner bore of each plate has the same diameter of 45 mm ϕ.

FIGS. 4A and 4B depict an inventive sample 1 in which only the intermediate plate is formed with the inclined portions, wherein: the length of the inner bore of the intermediate plate in the sliding direction, at an upper edge of the intermediate plate is 60 mm; the length of the inner bore of the intermediate plate in the sliding direction, at a lower edge of the intermediate plate is 55 mm; the length of the inner bore of the intermediate plate in a direction orthogonal to the sliding direction is 50 mm; an inner bore wall surface of the intermediate plate is a smoothly curved surface shape; and an inner bore of each of upper and lower plates is 45 mm ϕ. The vertical length of each of an upper inclined portion and a lower inclined portion on the slidingly closing directional trailing-side of the intermediate plate is 13 mm, and the vertical length of a convex portion between the upper and lower inclined portions is 10 mm.

FIGS. 5A and 5B depict an inventive sample 2 in which, in addition to the upper plate and the intermediate plate in FIGS. 4A and 4B (inventive sample 1), the lower plate is also formed with the fourth inclined portion on the slidingly closing directional leading-side, wherein the length of an inner bore of the lower plate in the sliding direction, at an upper edge of the lower plate, was 60 mm.

In the comparative sample 1 depicted in FIGS. 3A and 3B, a stagnation region of molten steel is formed in a recessed space of the inner bore of the intermediate plate sandwiched between the upper plate and the lower plate, an upper end of a slidingly closing directional trailing-side wall surface of the inner bore of the lower plate, and a slidingly closing directional trailing-side wall surface of an inner bore of an immersion nozzle (lower nozzle) (FIG. 3A). As a result, adhesion and deposition of metal oxides and others significantly occur in the recessed space of the inner bore of the intermediate plate, and the slidingly closing directional trailing-side inner bore wall surfaces of the lower plate and the immersion nozzle (FIG. 3B, FIG. 9).

Differently, in the inventive sample depicted in FIGS. 4A and 4B, a downward molten steel stream is formed in the recessed space of the inner bore of the intermediate plate, and an upward stream is also formed by the downwardly contracting first inclined portion, so that a stagnation state of molten steel in the recessed space of the inner bore of the intermediate plate is suppressed. Further, a stagnation region which would otherwise occur in a step-like region between a lower end of the upper plate and a part of an upper sliding surface of the intermediate plate on the slidingly closing directional trailing-side is reduced by the presence of the upper inclined portion. Further, in the inventive sample 1, a space defined at an angle of 90-degree between an upper end of the lower plate and a part of a lower sliding surface of the intermediate plate on the slidingly closing directional trailing-side, as observed in the comparative sample 1, is reduced by the presence of the lower inclined surface formed as a smoothly curved surface, so that stagnation of molten steel is also suppressed in this region (FIG. 4A). As a result, the level of adhesion of metal oxides and others in the recessed space of the inner bore of the intermediate plate and on the slidingly closing directional trailing-side inner bore wall surfaces of the lower plate and the immersion nozzle is reduced (FIG. 4B, FIG. 9).

In the inventive sample 2 depicted in FIGS. 5A and 5B, the downward stream in the recessed space of the inner bore of the intermediate plate in the inventive sample 1 is further promoted, so that the stagnation state of molten steel in the recessed space of the inner bore of the intermediate plate is further suppressed (FIG. 5A). As a result, the level of adhesion of metal oxides and others in the recessed space of the inner bore of the intermediate plate and on the slidingly closing directional trailing-side inner bore wall surfaces of the lower plate and the immersion nozzle is further reduced as compared to the inventive sample 1 (FIG. 5B, FIG. 9).

Example B

Example B is an experimental example in which a sliding nozzle configured such that a central axis of an inner bore of an upper plate lies non-coaxially with a central axis of an inner bore of a lower plate, and the central axis of the inner bore of the lower plate is offset on the slidingly closing directional leading-side with respect to the central axis of the inner bore of the upper plate by 10 mm is used to check the flow pattern of molten steel in inner bores and the state of adhesion and deposition of metal oxides and others on inner bore wall surfaces.

Figure 6A:
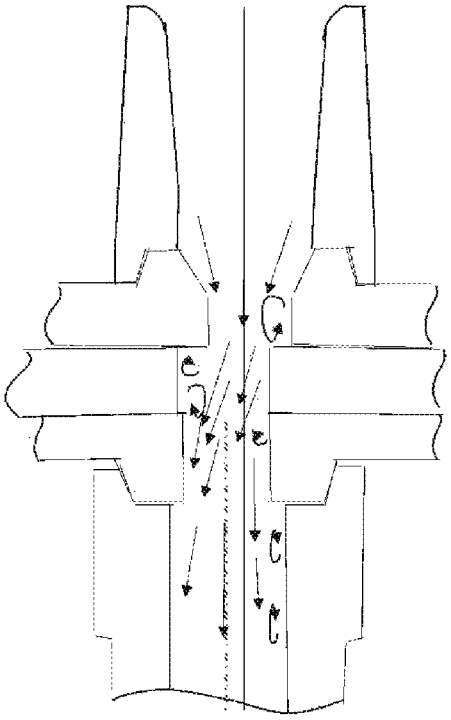
FIG. 6A is a schematic diagram depicting a flow pattern of molten steel in inner bores of a conventional sliding nozzle as a comparative sample 2 in which a central axis of inner bores of an upper plate and an upper nozzle lies non-coaxially with a central axis of an inner bore of a lower plate.
Figure 6B:
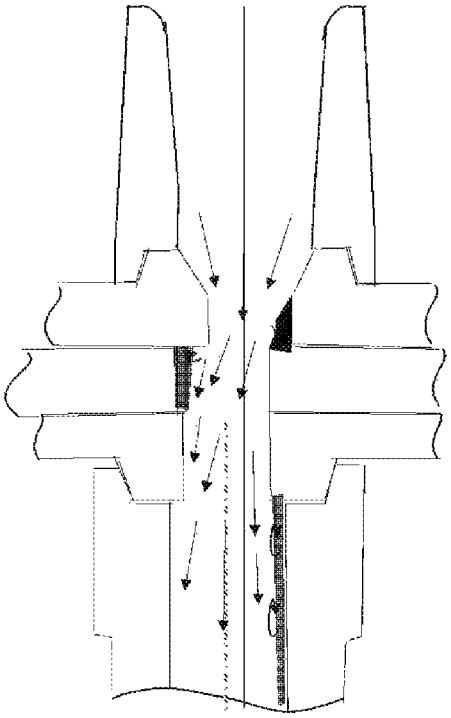
FIG. 6B is a schematic diagram depicting a state of adhesion of metal oxides and others on the inner bores in the conventional sliding nozzle as the comparative sample 2 in FIG. 6A.
Figure 7A:
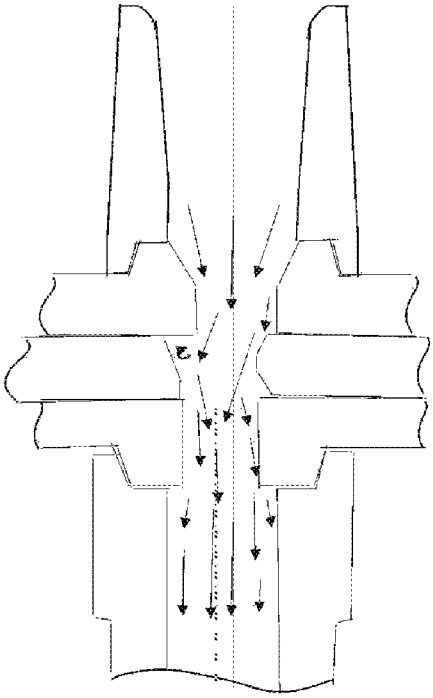
FIG. 7A is a schematic diagram depicting a flow pattern of molten steel in inner bores of a sliding nozzle as an inventive sample 3 in which a central axis of inner bores of an upper plate and an upper nozzle lies non-coaxially with a central axis of an inner bore of a lower plate, and an intermediate plate has an inclined portion defining a part of an inner bore wall surface thereof.
Figure 7B:
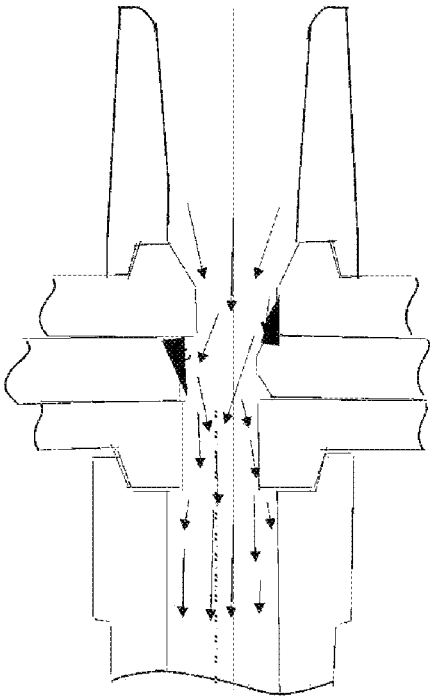
FIG. 7B is a schematic diagram depicting a state of adhesion of metal oxides and others on the inner bores in the sliding nozzle as the inventive sample 3 in FIG. 7A.
Figure 8A:
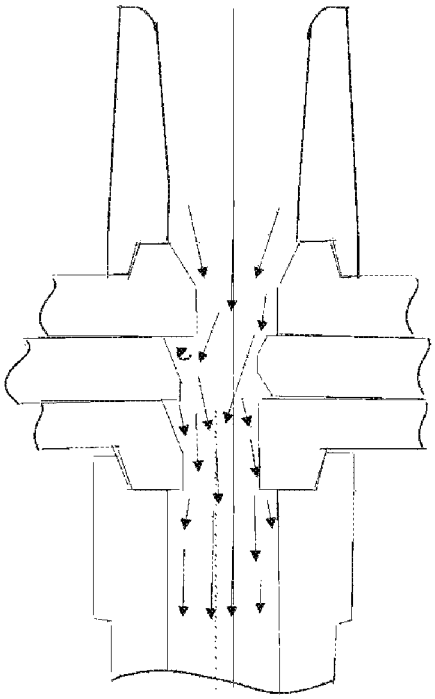
FIG. 8A is a schematic diagram depicting a flow pattern of molten steel in inner bores of a sliding nozzle as an inventive sample 4 in which a central axis of inner bores of an upper plate and an upper nozzle lies non-coaxially with a central axis of an inner bore of a lower plate, and each of an intermediate plate and the lower plate has an inclined portion defining a part of an inner bore wall surface thereof.
Figure 8B:
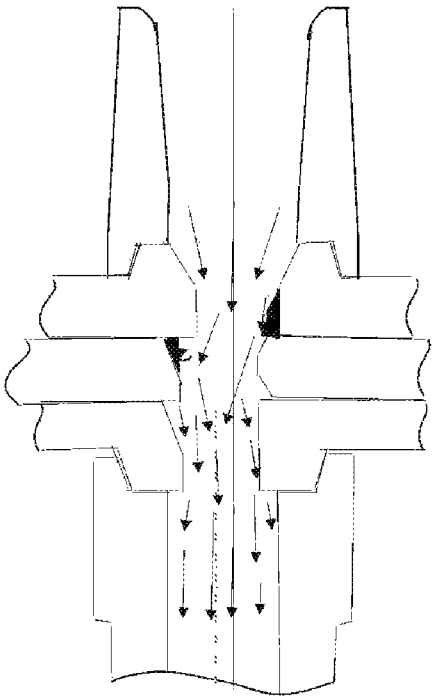
FIG. 8B is a schematic diagram depicting a state of adhesion of metal oxides and others on the inner bores in the sliding nozzle as the inventive sample 4 in FIG. 8A.

FIG. 6A, FIG. 7A and FIG. 8A are schematic diagrams depicting respective structures of a comparative sample 2 and inventive samples 3 and 4, and FIG. 6B, FIG. 7B and FIG. 8B are schematic diagrams depicting respective states of adhesion and deposition of metal oxides and others on inner bore wall surfaces of these sliding nozzles. FIG. 9 is a graph presenting a relative relationship of the states of adhesion of metal oxides and others in FIGS. 6B, 7B and 8B, wherein the thickness of an adhesion layer of the metal oxides and others is indicated by the maximum thickness index.

In the comparative sample 2 depicted in FIGS. 6A and 6B, a stagnation region of molten steel is formed in a recessed space of an inner bore of an intermediate plate sandwiched between the upper plate and the lower plate, an upper end of a slidingly closing directional trailing-side wall surface of the inner bore of the lower plate, and a slidingly closing directional trailing-side wall surface of an inner bore of an immersion nozzle (lower nozzle). However, as compared to the comparative sample 1, in the comparative sample 2, a downward molten steel stream is increased in the recessed space of the inner bore of the intermediate plate, so that a contact of molten steel with the slidingly closing directional trailing-side inner bore wall surface of the immersion nozzle tends to decrease (FIG. 6A). As a result, adhesion and deposition of metal oxides and others in the recessed space of the inner bore of the intermediate plate and thus particularly on the slidingly closing directional trailing-side inner bore wall surfaces of the lower plate and the immersion nozzle are further reduced as compared to the comparative sample 1 (FIG. 6B, FIG. 9).

In the inventive sample 3 (FIGS. 7A and 7B) and the inventive sample 4 (FIGS. 8A and 8B), the inventive sample 3 and the inventive sample 4 are improved as compared, respectively, to the inventive sample 1 and the inventive sample 2, as the comparative sample 2 is further improved as compared to the comparative sample 1. Particular, in terms of the adhesion and deposition of metal oxides and others on the slidingly closing directional trailing-side inner bore wall surfaces of the lower plate and the immersion nozzle, the inventive sample 3 and the inventive sample 4 are suppressed as compared, respectively, to the inventive sample 1 and the inventive sample 2 (FIG. 7B, FIG. 8B, FIG. 9).

LIST OF REFERENCE SIGNS

1: upper plate
1G: gas injection refractory member installed to upper plate
1L: inner bore dimension of lower end of upper plate in sliding direction of intermediate plate
2: intermediate plate
2*a*: first inclined portion
2*b*: second inclined portion (upper inclined portion)
2*c*: third inclined portion (lower inclined portion)
2U: inner bore dimension of upper edge of intermediate plate in sliding direction of intermediate plate
2L: inner bore dimension of lower edge of intermediate plate in sliding direction of intermediate plate
3: lower plate
3*a*: fourth inclined portion
3U: inner bore dimension of upper edge of lower plate in sliding direction of intermediate plate
4: inner bore
5: center axis of inner bores of upper plate and upper plate
6: center axis of inner bore of lower plate
7: upper nozzle
7G: gas injection refractory member installed to upper nozzle
8: immersion nozzle (lower nozzle)
10: sliding nozzle

The invention claimed is:

1. A sliding nozzle for controlling a flow rate of molten steel, comprising three plates consisting of an upper plate, an intermediate plate capable of a sliding movement, and a lower plate, wherein the intermediate plate has: a first inclined portion whose defines a slidingly closing directional leading-side wall surface of an inner bore thereof and extends obliquely downwardly in a direction away from the leading-side wall surface; a second inclined portion whose surface defines an upper part of a slidingly closing directional trailing-side wall surface of the inner bore thereof and extends obliquely downwardly in a direction away from the trailing-side wall surface, and a third inclined portion whose surface defines a lower part of the slidingly closing directional trailing-side wall surface of the inner bore thereof and extends obliquely downwardly in a direction towards the trailing-side wall surface.

2. The sliding nozzle as recited in claim 1, wherein the lower plate has a fourth inclined portion whose surface defines a slidingly closing directional leading-side wall surface of an inner bore thereof and extends obliquely downwardly in a direction away from the leading-side wall surface.

3. The sliding nozzle as recited in claim 1, wherein respective sliding directional inner bore dimensions of the intermediate plate and the upper plate in a region where the intermediate plate and the upper plate are in sliding contact with each other satisfy the following relation: the inner bore dimension of the intermediate plate≥the inner bore dimension of the upper plate, and respective sliding directional inner bore dimensions of the lower plate and the intermediate plate in a region where the lower plate and the intermediate plate are in sliding contact with each other satisfy the following relation: the inner bore dimension of lower plate≥the inner bore dimension of the intermediate plate.

4. The sliding nozzle as recited in claim 1, wherein a central axis of an inner bore of the upper plate or upper inner bore axis lies non-coaxially with a central axis of an inner bore of the lower plate or lower inner bore axis, wherein the lower inner bore axis is offset on the slidingly closing directional leading-side with respect to the upper inner bore axis.

5. The sliding nozzle as recited in claim 1, which further comprises a refractory member installed to at least one of the upper plate and an upper nozzle located above the upper plate and configured to inject gas into an inner bore of the at least one of the upper plate and the upper nozzle.

* * * * *